US010085084B2

(12) United States Patent
Kim et al.

(10) Patent No.: US 10,085,084 B2
(45) Date of Patent: Sep. 25, 2018

(54) WEARABLE DEVICE WITH SOUND SEALING STRUCTURE

(71) Applicant: SAMSUNG ELECTRONICS CO., LTD., Suwon-si, Gyeonggi-do (KR)

(72) Inventors: Seonmi Kim, Suwon-si (KR); Sunghan Park, Suwon-si (KR); Myoungsung Sim, Hwaseong-si (KR); Sangju Lee, Suwon-si (KR); Juhee Chang, Seongnam-si (KR); Hwangyun Cho, Hwaseong-si (KR); Janghoon Kang, Seoul (KR); Myungcheol Lee, Suwon-si (KR); Ho-Chul Hwang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/412,410

(22) Filed: Jan. 23, 2017

(65) Prior Publication Data

US 2017/0280230 A1 Sep. 28, 2017

(30) Foreign Application Priority Data

Mar. 24, 2016 (KR) ..... 10-2016-0035250

(51) Int. Cl.
*H04R 25/00* (2006.01)
*H04R 1/10* (2006.01)

(52) U.S. Cl.
CPC ..... *H04R 1/1066* (2013.01); *H04R 1/1016* (2013.01); *H04R 1/1083* (2013.01); *H04R 1/1058* (2013.01)

(58) Field of Classification Search
CPC .. H04R 1/1066; H04R 1/1016; H04R 1/1083; H04R 1/1058
See application file for complete search history.

(56) References Cited

U.S. PATENT DOCUMENTS 7,724,539 B2 5/2010 Konno
9,210,492 B2 12/2015 Dave et al.
(Continued)

FOREIGN PATENT DOCUMENTS

JP 2011-211458 10/2011
KR 10-2005-0037817 4/2005

OTHER PUBLICATIONS

Huawei Official Site, http://consumer.huawei.com/en/mobile-phones/Ascend-Mate7/index.htm, Oct. 25, 2016, 7 pages.

*Primary Examiner* — Tuan D Nguyen
(74) *Attorney, Agent, or Firm* — Nixon & Vanderhye P.C.

(57) ABSTRACT

The present disclosure discloses a wearable device with a sound sealing structure. The disclosed device may include a housing having at least one or more sound holes, at least one or more substrates fixed inside the housing, and at least one or more sound element portions disposed in the housing to face a $1^{st}$ direction(+) and including a sound path comprising a duct structure for connection to the sound hole. At least one or more coupling structures on which a coupling force is exerted in a $2^{nd}$ direction facing a vertical direction of the $1^{st}$ direction may be formed between the housing and the sound element portion, and the sound element portion may be prevented from and/or resist being moved back in a $1^{st}$ direction(−) due to the at least one or more coupling structures.

15 Claims, 10 Drawing Sheets

(56) References Cited

U.S. PATENT DOCUMENTS

| | | | | |
|---|---|---|---|---|
| 2007/0071265 | A1* | 3/2007 | Leedom | H04R 25/608<br>381/322 |
| 2009/0318198 | A1* | 12/2009 | Carroll | H04M 1/6066<br>455/569.1 |
| 2013/0004011 | A1* | 1/2013 | Hayashida | H04R 1/1016<br>381/380 |
| 2015/0055810 | A1* | 2/2015 | Shin | H04R 1/1083<br>381/332 |

* cited by examiner

WEARABLE DEVICE WITH SOUND SEALING STRUCTURE

CROSS-REFERENCE TO RELATED APPLICATION

This application is based on and claims priority under 35 U.S.C. § 119 to a Korean patent application filed in the Korean Intellectual Property Office on Mar. 24, 2016 and assigned Serial No. 10-2016-0035250, the disclosure of which is incorporated by reference herein in its entirety.

BACKGROUND

1. Field of the Disclosure

The present disclosure relates generally to a wearable device with a sound sealing structure, and for example, to a wearable device worn in an ear.

2. Description of Related Art

In general, an electronic device related to a sound is associated with an auditory function, and may be worn in a portion nearby an ear. For example, the electronic device related to the sound may be used as an ear-attached type (or a wearable device), and at least one or more sound-related elements may be mounted thereon. The sound element may be mounted inside the electronic device, and may have a duct structure for connection to the outside.

For example, the sound element may include a speaker, a microphone, a receiver, or the like. The sound element may be mounted on at least one or more electronic devices by using the duct structure for connection to the outside.

However, since an inner space is limited in a small-sized device, there is a problem in that an additional sealing structure does not exist in a path for connecting a sound element to the outside, or there is no space for installing the sealing structure. This may lead to quality deterioration of the sound element.

SUMMARY

Various example embodiments of the present disclosure may provide an apparatus for improving performance of a sound element by providing a sound sealing structure on a sound path of the sound element without having to increase an overall size in a limited mounting space of a small-sized wearable device such as an ear set or ear bud.

Various example embodiments of the present disclosure may provide a wearable device with a sound sealing structure of a microphone suitable for miniaturization.

According to various example embodiments of the present disclosure, a wearable device may include a housing having at least one or more sound holes, at least one or more substrates fixed inside the housing, and at least one or more sound element portions disposed in the housing to face a $1^{st}$ direction(+) and having a sound path comprising a duct structure for connection to the sound hole. At least one or more coupling structures on which a coupling force is exerted in a $2^{nd}$ direction facing a vertical direction of the $1^{st}$ direction may be formed between the housing and the sound element portion. The sound element portion may be prevented from and/or resist being moved back in a $1^{st}$ direction (−) due to the at least one or more coupling structures.

According to various example embodiments of the present disclosure, a wearable device may include an ear mold, a housing worn in an ear by means of the ear mold and having at least one or more sound holes, a supporting structure coupled to the housing to fix an internal element, at least one or more substrates supported by a supporting structure in the housing, and at least one or more sound element portions placed in the housing to face a $1^{st}$ direction (+) and having a duct structure for connection to the sound hole. At least one or more coupling structures may be formed in a $2^{nd}$ direction facing a vertical direction of the $1^{st}$ direction(+) between the supporting structure and the sound element portion. The sound element portion may be prevented from and/or resist being moved in the $1^{st}$ direction(−) due to the at least one or more coupling structures, and thus a sealing may be achieved between the sound hole and the duct structure.

Various example embodiments of the present disclosure may provide a sealing structure of a sound element by avoiding a movement of a sound element portion mounted on a wearable device worn in an ear. The sealing structure of the sound element can advantageously improve sound quality.

BRIEF DESCRIPTION OF THE DRAWINGS

These and other features and attendant advantages of the present disclosure with be more readily appreciated and understood from the following detailed description, taken in conjunction with the accompanying drawings, in which like reference numerals refer to like elements, and wherein.

DETAILED DESCRIPTION

Figure 1:
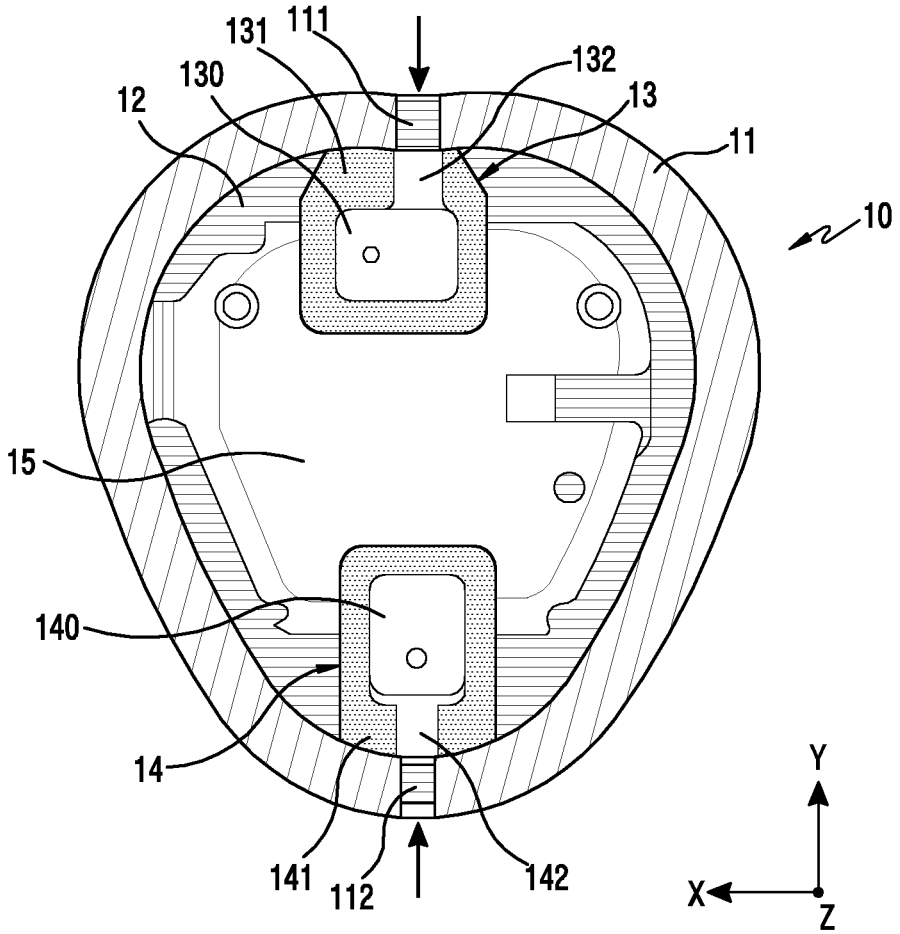
FIG.1 PRIOR ART
FIG. 1 is a cross-sectional view illustrating a state in which $1^{st}$ and $2^{nd}$ sound element portions are disposed in a wearable device according to the prior art.

Hereinafter, various example embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

As used herein, the expression "have", "may have", "include", or "may include" refers to the existence of a corresponding feature (e.g., numeral, function, operation, or constituent element such as component), and does not exclude one or more additional features.

In the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expressions such as "first", "second", or the like used in various embodiments of the present disclosure may modify various elements regardless of order or importance, and do not limit corresponding elements. The above-described expressions may be used to distinguish an element from another element. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposed between them. On the other hand, it may be understood that when an element (e.g., first element) is referred to as being "directly connected," or "directly coupled" to another element (second element), there are no element (e.g., third element) interposed between them.

The expression "configured to" used in the present disclosure may be exchanged with, for example, "suitable for", "having the capacity to", "designed to", "adapted to", "made to", or "capable of" according to the situation. The expression "configured to" may not necessarily mean "specially designed to" in terms of hardware. Alternatively, in some situations, the expression "device configured to" may refer, for example, to a situation in which the device, together with other devices or components, "is able to". For example, the phrase "processor adapted (or configured) to perform A, B, and C" may refer, for example, to various processing circuitry, such as, for example, and without limitation, a dedicated processor (e.g., embedded processor) only for performing the corresponding operations or a generic-purpose processor (e.g., central processing unit (CPU) or application processor (AP)) that can perform the corresponding operations by executing one or more software programs stored in a memory device.

The terms used herein are merely for the purpose of describing particular embodiments and are not intended to limit the scope of other embodiments. As used herein, singular forms may include plural forms as well unless the context clearly indicates otherwise. Unless defined otherwise, all terms used herein, including technical terms and scientific terms, may have the same meaning as commonly understood by a person of ordinary skill in the art to which the present disclosure pertains. Terms, such as those defined in commonly used dictionaries, should be interpreted as having a meaning that is the same or similar to their meaning in the context of the relevant art and will not be interpreted in an idealized or overly formal sense unless expressly so defined herein. In some cases, even where the term is defined in the present disclosure it should not be interpreted to exclude embodiments of the present disclosure.

Hereinafter, various example embodiments of the present disclosure will be described with reference to the accompanying drawings.

Hereinafter, a structure of a wearable device will be described in greater detail according to various example embodiments with reference to the accompanying drawings. An orthogonal coordinate system may be used in each drawing. In the drawing, a Y-axis may denote a $1^{st}$ direction, an X-axis may denote a $2^{nd}$ direction, and a Z-axis may denote a $3^{rd}$ direction. The $1^{st}$ direction may include a $1^{st}$ direction(+) and a $1^{st}$ direction(−). The $1^{st}$ direction(−) may be an opposite direction of the $1^{st}$ direction(+). The $2^{nd}$ direction may include a $2^{nd}$ direction(+) and a $2^{nd}$ direction (−). The $2^{nd}$ direction(−) may be an opposite direction of the $2^{nd}$ direction(+). The $3^{rd}$ direction may include a $3^{rd}$ direction(+) and a $3^{rd}$ direction(−). The $3^{rd}$ direction(−) may be an opposite direction of the $3^{rd}$ direction(+).

FIG. 1 is a cross-sectional view illustrating an example state in which $1^{st}$ and $2^{nd}$ sound element portions are disposed in a wearable device according to the prior art.

Disposing of $1^{st}$ and $2^{nd}$ sound element portions 13 and 14 mounted on a wearable device 10 will be described according to the prior art with reference to FIG. 1. The wearable device 10 according to the prior art may have a housing 11 in which the $1^{st}$ sound element portion 13 facing a $1^{st}$ direction(+) and the $2^{nd}$ sound element portion 14 facing a $1^{st}$ direction(−) opposite to the direction of the $1^{st}$ sound element portion 13 are disposed.

The $1^{st}$ sound element portion 13 may include a $1^{st}$ sound element 130 and a $1^{st}$ sound cover portion 131 for covering the $1^{st}$ sound element 130. The $2^{nd}$ sound element portion 14 may include a $2^{nd}$ sound element 140 and a $2^{nd}$ sound cover portion 141 for covering the $2^{nd}$ sound element 140. For example, $1^{st}$ and $2^{nd}$ sound elements 130 and 140 may include a microphone. The $1^{st}$ sound element portion 13 may be connected to a $1^{st}$ sound hole 111 formed to the outside of the housing by means of a $1^{st}$ duct 132, and the $2^{nd}$ sound element portion 14 may be connected to a $2^{nd}$ sound hole 112 formed to the outside of the housing 11 by means of a $2^{nd}$ duct 142. The $1^{st}$ and $2^{nd}$ sound element portion 13 and 14 may be disposed on a substrate 15 to face each other, and may be fixed by means of a supporting structure 12.

However, since the wearable device 10 according to the prior art is a small-sized electronic device worn in an ear such as an ear set, it is difficult to implement a sealing structure of the $1^{st}$ and $2^{nd}$ element portions 130 and 140 in a small limited space. This may lead to sound quality deterioration of the sound element.

For example, a limited and very narrow inner mounting space of the wearable device 10 does not have any supporting structure in which the $1^{st}$ and $2^{nd}$ sound element portions 13 and 14 are tightly attached to the $1^{st}$ and $2^{nd}$ sound holes 111 and 112 in the $1^{st}$ direction. Therefore, there is a structural problem in that a sealing is not achieved between the $1^{st}$ sound hole 111 and the $1^{st}$ duct 132 and between the second sound hole 112 and the $2^{nd}$ duct 142.

When a sealing supporting structure of $1^{st}$ and $2^{nd}$ element portions is implemented in the housing of the wearable device, an overall size of the wearable device is increased, which may lead to inconvenience in wearing.

Hereinafter, a structure of a wearable device will be described in detail according to various example embodiments of the present disclosure. An orthogonal coordinate system may be used in each drawing.

Figure 2:
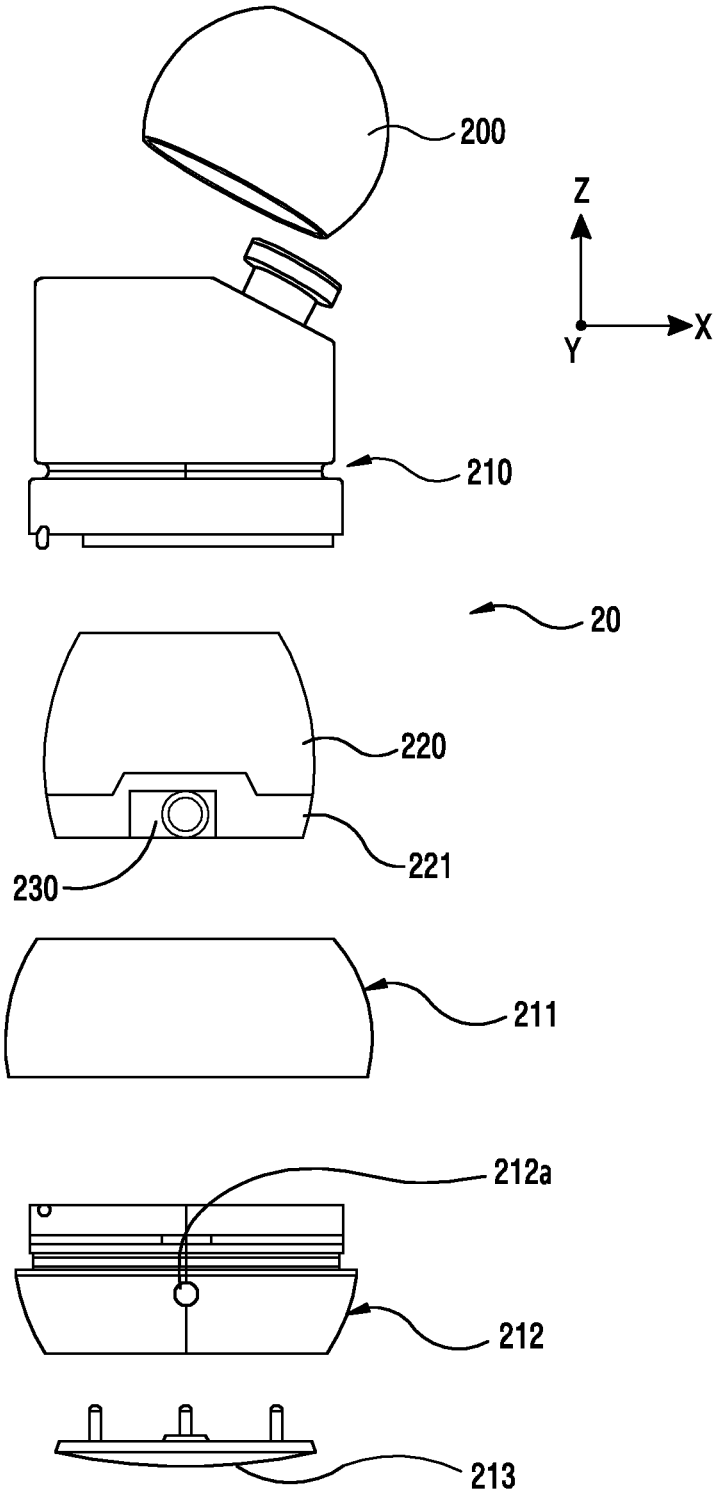
FIG. 2 is an exploded plan view illustrating an example structure of a wearable device according to various example embodiments of the present disclosure.

FIG. 2 is an exploded plan view illustrating an example structure of a wearable device according to various example embodiments of the present disclosure.

Referring to FIG. 2, a wearable device 20 according to the various example embodiments is a wearable device worn on a human body, for example, an auditory electronic device related to a sound, and may be a small-sized wearable device including an ear set, a earphone, a hearing aid, an ear-type head set, or the like worn in an ear. For example, the wearable device 20 according to the various example embodiments may be a small-sized wearable device which can be worn in an ear by using an ear mold 200 having an elasticity and size enough to be worn in the ear.

The wearable device 20 according to the various example embodiments has at least one or more sound elements mounted thereon, and thus may include a sound sealing structure of the sound element. The sound sealing structure is defined as a sealing structure installed on a sound path which reaches the sound element, and may be a structure for avoiding a sound leakage on the path through which a sound flows. For example, as an element related to a human auditory sense, the sound element may include at least one or more microphones or at least one or more speakers or a combination thereof or the like.

Figure 4:
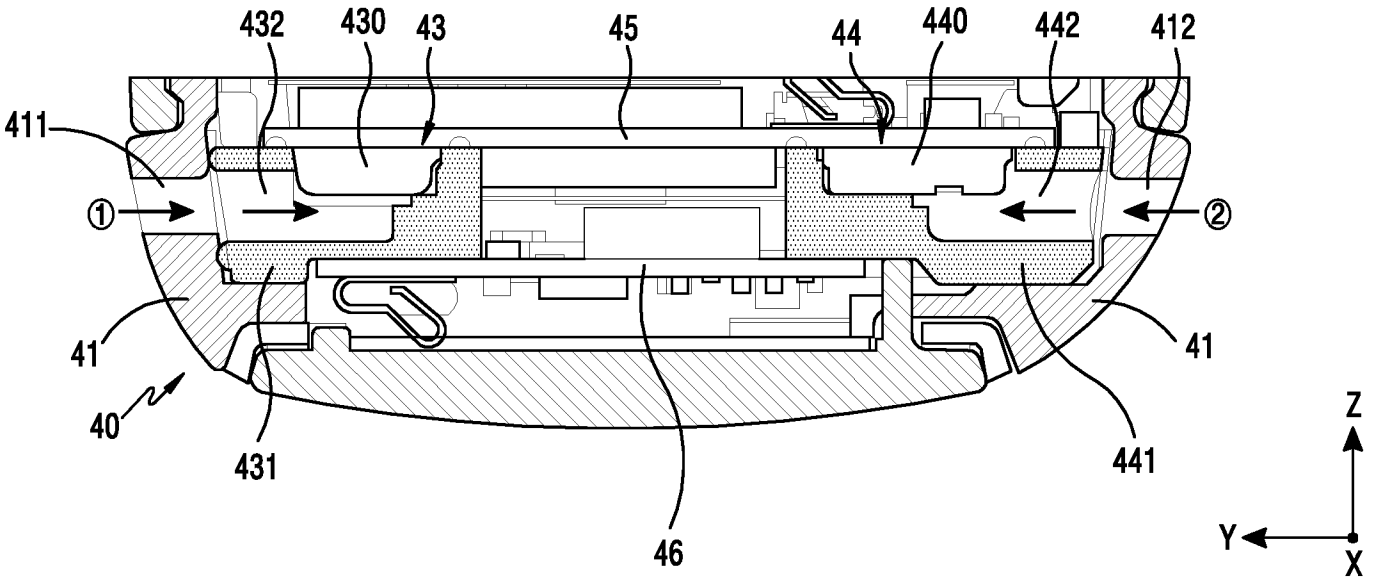
FIG. 4 is a cutaway cross-sectional view illustrating an example state in which $1^{st}$ and $2^{nd}$ sound element portions are placed in a wearable device (in a direction of a YZ plane) according to various example embodiments of the present disclosure.

The wearable device 20 according to the various example embodiments may include at least one or more housings 210, 211, and 212, at least one or more supporting structures 220 and 221, at least one or more sounding element portions 230, at least one or more coupling structures (see FIG. 5), and at least one or more substrates (i.e., Printed Circuit Board Assemblies (PCBAs)) (see FIG. 4).

The wearable device 20 according to the various example embodiments may include the $1^{st}$ housing 210 coupled to the ear mold 200 and wearable in an ear (an inner ear), the $2^{nd}$ housing 211 coupled to the $1^{st}$ housing 210, and the $3^{rd}$ housing 212 coupled to the $2^{nd}$ housing 211 and having a sound hole 212*a* of the sound element. Further, the $3^{rd}$ housing 212 may further include a cover 213 capable of opening and closing the inside of the housing. The $1^{st}$, $2^{nd}$, and $3^{rd}$ housings 210, 211, and 212 may be collectively called a body housing.

Figure 5:
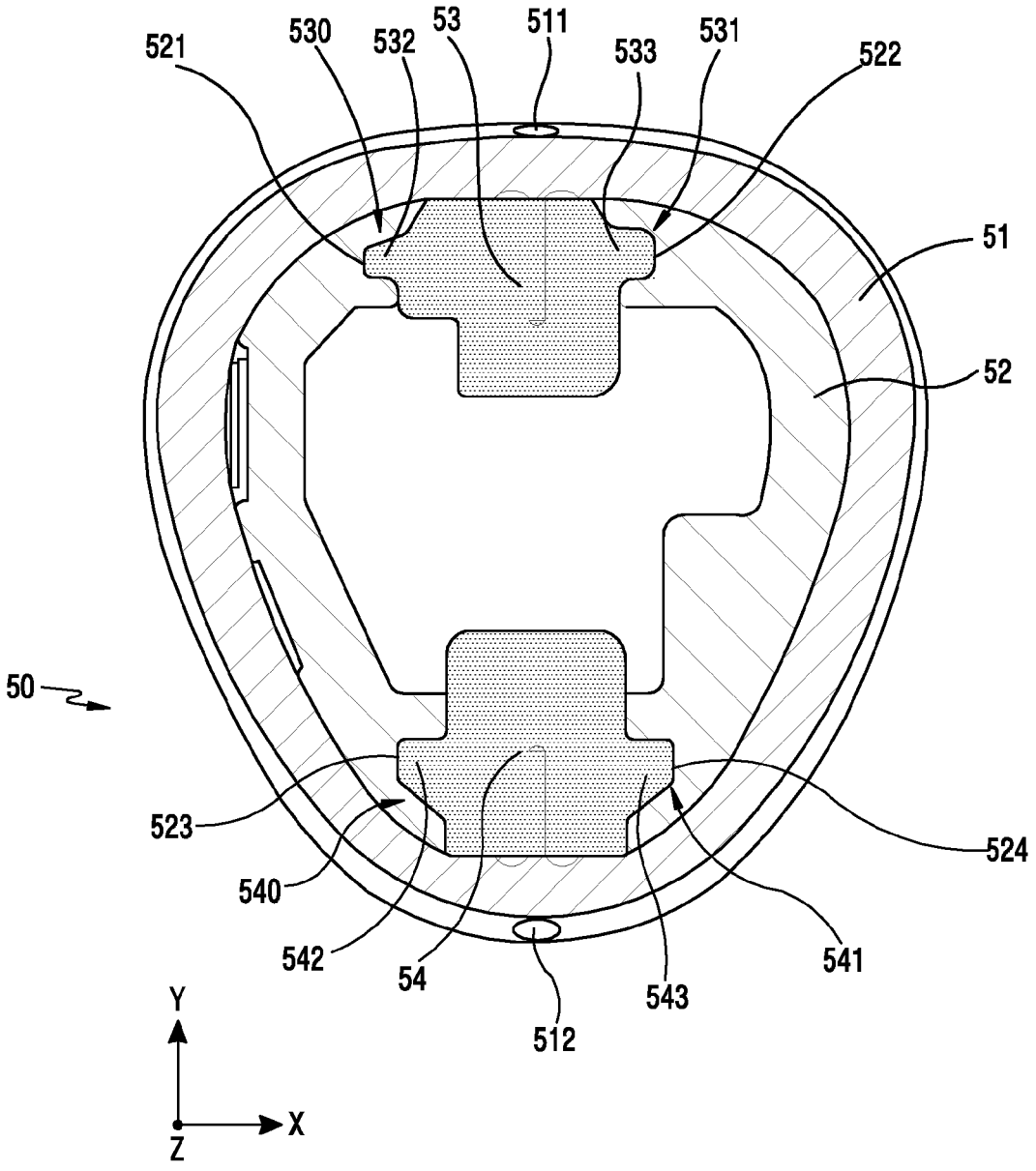
FIG. 5 is a cutaway cross-sectional view illustrating an example state in which $1^{st}$ and $2^{nd}$ sound element portions are placed in a wearable device (in a direction of an XY plane) according to various example embodiments of the present disclosure.

The body housing according to the various example embodiments may contain the at least one or more supporting structures 220 and 221, the at least one or more sound element portions 230, and the at least one or more substrates (see FIG. 5). The body housing according to the various example embodiments may have the at least one or more sound holes 212*a* spatially connected to the sound element portion 230 and providing a sound path for reaching the sounding element.

For example, the supporting structures 220 and 221 according to the various example embodiments are inner supporting members (e.g., brackets) for fixing an element inside the body housing, and at least one or more of the supporting structures 220 and 221 may be coupled to an inner portion of the body housing to support at least one or more substrates (see FIG. 5), at least one or more sound element portions 230, a sensor (not shown), a battery (not shown), a button (not shown), or the like. For example, as the inner supporting structure, the supporting structure may include the $1^{st}$ supporting structure 220 and the $2^{nd}$ supporting structure 221. The $1^{st}$ supporting structure may support a $1^{st}$ substrate, a battery, a sensor, or the like, and the $2^{nd}$ supporting substrate may support at least one or more sound element portions 230 or the like. Both or one of the $1^{st}$ and $2^{nd}$ supporting structures 220 and 221 may include an injection material, a metal material, an alloy material, or a combination thereof. If a plurality of substrates must be fixed inside the housing in a multi-layered manner, the substrates may be supported by being coupled respectively to the supporting structures 220 and 221.

Figure 3:
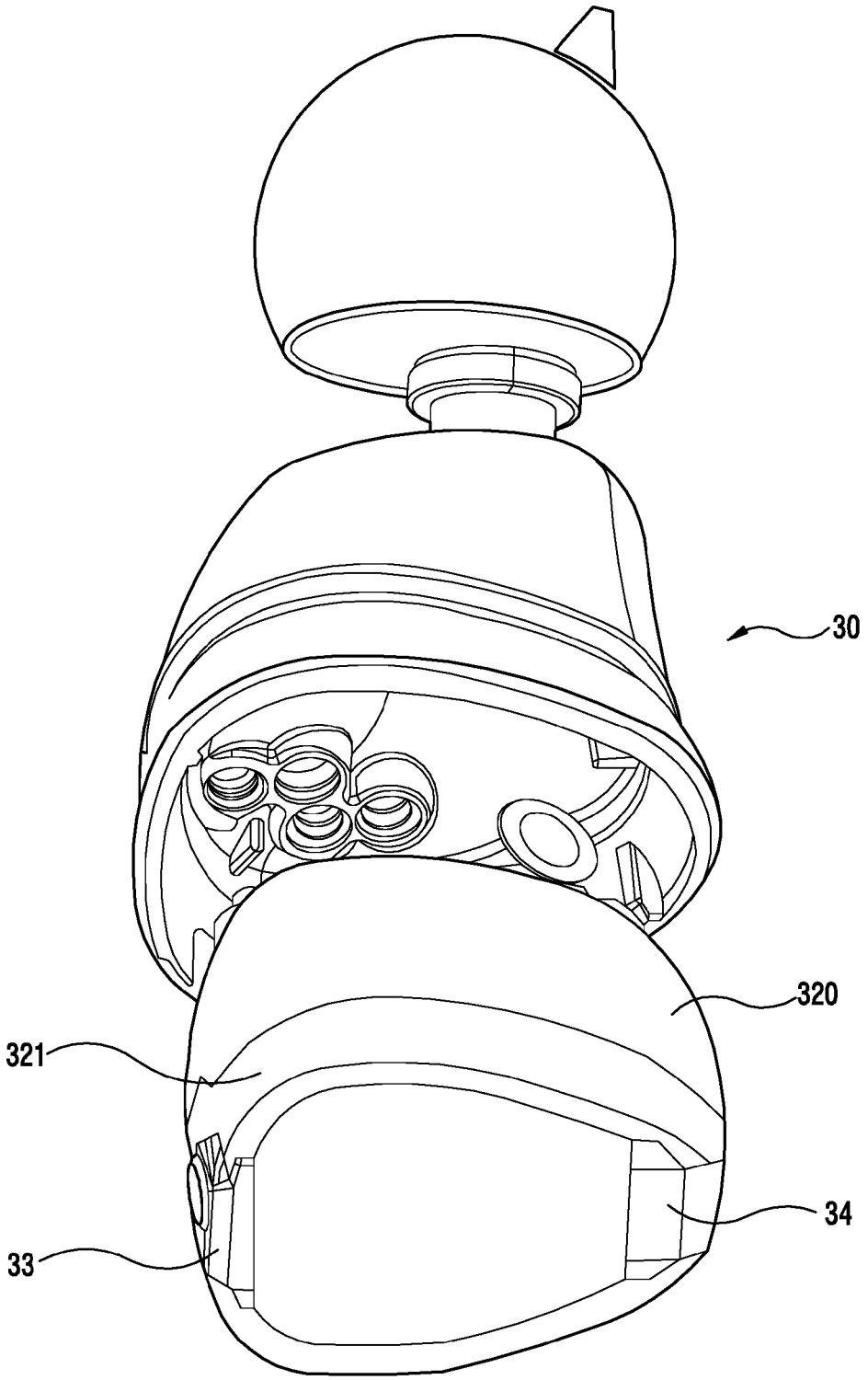
FIG. 3 is a perspective view illustrating an example state in which $1^{st}$ and $2^{nd}$ sound element portions are placed on a supporting structure of a wearable device according to various example embodiments of the present disclosure.

FIG. 3 is a perspective view illustrating a state in which $1^{st}$ and $2^{nd}$ sound element portions are placed on a supporting structure of a wearable device according to various example embodiments of the present disclosure.

Referring to FIG. 3, a wearable device 30 according to the various example embodiments may be the same device as the wearable device 20 of FIG. 2. The wearable device 30 according to the various example embodiments may have a housing in which $1^{st}$ and $2^{nd}$ supporting structures 320 and 321 are disposed, and at least one or more sound element portions 33 and 34 may be fixed to the $2^{nd}$ supporting structure 321. The sound element portion according to the various example embodiments may include the $1^{st}$ and $2^{nd}$ sound element portions 33 and 34, and the $1^{st}$ and $2^{nd}$ sound element portions 33 and 34 may be disposed to face each other about a substrate 35. The $1^{st}$ and $2^{nd}$ sound element portions 33 and 34 may be disposed to directly face each other on the substrate 35, and may be placed to be connected respectively to the $1^{st}$ and $2^{nd}$ sound holes (see FIG. 4). A plurality of electronic elements mounted on the substrate may be located between the $1^{st}$ and $2^{nd}$ sound element portions 33 and 34.

FIG. 4 is a cutaway cross-sectional view illustrating a state in which $1^{st}$ and $2^{nd}$ sound element portions are disposed in a wearable device (in a direction of a YZ plane) according to various example embodiments of the present disclosure.

Referring to FIG. 4, a wearable device 40 according to the various example embodiments may be the same device as the respective wearable devices 20 and 30 of FIG. 2 and FIG. 3. The wearable device 40 according to the various example embodiments may include $1^{st}$ and $2^{nd}$ substrates 45 and 46 (i.e., Printed Circuit Board Assemblies (PCBAs)) disposed in a multi-layer type. The $1^{st}$ and $2^{nd}$ substrates 45 and 46 may be fixed to face each other by being supported by means of a supporting structure. $1^{st}$ and $2^{nd}$ sound element portions 43 and 44 may be disposed to face each other between the $1^{st}$ and $2^{nd}$ substrates 45 and 46.

The wearable device 40 according to the various example embodiments may include the $1^{st}$ and $2^{nd}$ sound element portions 43 and 44 disposed on a $1^{st}$ surface of the $1^{st}$ substrate 45. The $1^{st}$ and $2^{nd}$ sound element portions 43 and 44 may be disposed on the $1^{st}$ substrate to be in parallel with each other and to be separated from each other. The $1^{st}$ and $2^{nd}$ sound element portions 43 and 44 may be disposed to face each other between the $1^{st}$ and $2^{nd}$ substrates 45 and 46.

The $1^{st}$ sound element portion 43 may be disposed to face a $1^{st}$ direction(+), and the $2^{nd}$ sound element portion 44 may be disposed to face a $1^{st}$ direction(−) which is an opposite direction of the $1^{st}$ direction(+). In the $1^{st}$ sound element portion 43, an external sound of a housing 41 may proceed in an arrow direction ① by means of $1^{st}$ sound paths 411 and 432 and thereafter may reach a $1^{st}$ sound element 430. In the $2^{nd}$ sound element portion 44, an external sound may proceed in an arrow direction ② by means of $2^{nd}$ sound paths 412 and 442 and thereafter may reach a $2^{nd}$ sound element 440. The $1^{st}$ sound paths 411 and 432 have a duct type, and may be extended from an exterior of the housing 41 to up to the $1^{st}$ sound element 430. The $2^{nd}$ sound paths 412 and 442 have a duct type, and may be extended from the exterior of the housing 41 to up to the $2^{nd}$ sound element 440.

The $1^{st}$ sound element portion 43 according to the various example embodiments may include the $1^{st}$ sound element 430 and a $1^{st}$ sound cover portion 431 for covering the $1^{st}$ sound element 430. The $2^{nd}$ sound element portion 44 according to the various example embodiments may include the $2^{nd}$ sound element 440 and a $2^{nd}$ sound cover portion 441 for covering the $1^{st}$ sound element 440. For example, each of the $1^{st}$ and $2^{nd}$ sound elements 430 and 440 may include a microphone as an element related to an auditory sense. For example, the $1^{st}$ and $2^{nd}$ sound cover portions 431 and 441 have a sound sealing function, and thus may be respectively called $1^{st}$ and $2^{nd}$ sealing members or seals. For example, each of the $1^{st}$ and $2^{nd}$ sound cover portions 431 and 441 may include any one of a plastic material, a rubber material, a urethane material, and a silicon material, and may also have an injection structure or may be constructed by attaching a sponge or the like to a plastic material. The $1^{st}$ sound cover portion 431 may cover at least one surface or all remaining surfaces other than a contact surface of the $1^{st}$ sound element 430. The $2^{nd}$ sound cover portion 441 may cover at least one surface or all remaining surfaces other than a contact surface of the $2^{nd}$ sound element 440.

FIG. 5 is a cutaway cross-sectional view illustrating a state in which $1^{st}$ and $2^{nd}$ sound element portions are placed in a wearable device (in a direction of an XY plane) according to various example embodiments of the present disclosure.

Referring to FIG. 5, a wearable device 50 according to the various example embodiments may be the same device as the wearable device 40 of FIG. 4. The wearable device 50 according to the various example embodiments may include $1^{st}$ and $2^{nd}$ sound element portions 53 and 54. The $1^{st}$ sound element portion 53 according to the various example embodiments may be disposed to face a $1^{st}$ direction(+) of a housing 51. The $2^{nd}$ sound element portion 54 according to the various example embodiments may be disposed to face a $1^{st}$ direction(−) which is an opposite direction of the $1^{st}$ direction(+) of the housing 51. However, the $1^{st}$ direction(−) is not necessarily limited to the opposite direction of the $1^{st}$ direction(+). The $1^{st}$ direction(−) may face a vertical direction with respect to the $1^{st}$ direction(+), or may face a direction inclined by a specific angle with respect to the $1^{st}$ direction(+).

The wearable device 50 according to the various example embodiments may have at least one or more $1^{st}$ coupling structures 530 and 531 of the $1^{st}$ sound element portion 53 with respect to the XY plane, and thus may be prevented from and/or resist being moved (moved back) in the $1^{st}$ direction(−) of the $1^{st}$ sound element portion 53. The $1^{st}$ coupling structures 530 and 531 according to the various example embodiments may include $1^{st}$ protrusions 532 and 533 disposed to the $1^{st}$ sound element portion 53, and $1^{st}$ recesses 521 and 522 formed on a supporting structure 52 and tightly coupled to the $1^{st}$ protrusions 532 and 533. The $1^{st}$ coupling structures 530 and 531 may be tightly coupled by using an elasticity of a $1^{st}$ sound cover portion. The $1^{st}$ protrusions 532 and 533 and the $1^{st}$ recesses 521 and 522 may be configured in pair. According to a coupling structure between the $1^{st}$ protrusions 532 and 533 and the $1^{st}$ recesses 521 and 522, the $1^{st}$ sound element portion 53 may be prevented from being moved not only in a $2^{nd}$ direction (X direction) but also in the $1^{st}$ direction(−) (−Y direction). The $1^{st}$ coupling structures 530 and 531 may have a concavo-convex shape, but the present disclosure is not limited thereto.

The wearable device 50 according to the various example embodiments may have at least one or more $2^{nd}$ coupling structures 540 and 541 of the $2^{nd}$ sound element portion 54 with respect to the XY plane, and thus may be prevented from being moved in the $2^{nd}$ direction(+) of the $2^{nd}$ sound element portion 54. The $2^{nd}$ coupling structures 540 and 541 according to the various example embodiments may include $2^{nd}$ protrusions 542 and 543 disposed to the $2^{nd}$ sound element portion 54, and $2^{nd}$ recesses 523 and 524 formed on the supporting structure 52 and tightly coupled to the $2^{nd}$ protrusions 542 and 543. The $2^{nd}$ coupling structures 540 and 541 may be tightly coupled by using an elasticity of a $2^{nd}$ sound cover portion. The $2^{nd}$ protrusions 542 and 543 and the $2^{nd}$ recesses 523 and 524 may be configured in pair. According to a coupling structure between the $2^{nd}$ protrusions 542 and 543 and the $2^{nd}$ recesses 523 and 524, the $2^{nd}$ sound element portion 54 may be prevented from being moved not only in a $2^{nd}$ direction but also in the $1^{st}$ direction(+) (+Y direction). The $2^{nd}$ coupling structures 540 and 541 may have a concavo-convex shape, but the present disclosure is not limited thereto.

According to the various example embodiments, the $1^{st}$ protrusions 532 and 533 may protrude respectively in $2^{nd}$ directions (+,−) which are a vertical direction of the $1^{st}$ direction. The $2^{nd}$ protrusions 542 and 543 may protrude respectively in the $2^{nd}$ directions (+,−) which are the vertical direction of the $1^{st}$ direction. The $1^{st}$ recesses 521 and 522 according to the various example embodiments may be recessed (dented) respectively in the $2^{nd}$ directions (−,+) which are the vertical direction of the $1^{st}$ direction. The $2^{nd}$ recesses 523 and 524 may be recessed respectively in the $2^{nd}$ directions (−,+) which are the vertical direction of the $1^{st}$ direction.

Each of the $1^{st}$ and $2^{nd}$ coupling structures 530, 531, 540, and 541 according to the various example embodiments may be disposed to face the $2^{nd}$ direction, and thus the $1^{st}$ and $2^{nd}$ sound element portions 53 and 54 may be prevented from being moved in the $1^{st}$ direction. For example, the $1^{st}$ and $2^{nd}$ sound element portions 53 and 54 may be prevented from and/or resist being moved in a direction in which they approach to each other by means of the $1^{st}$ and $2^{nd}$ coupling structures 530, 531, 540, and 541. According to the $1^{st}$ and $2^{nd}$ coupling structures 530, 531, 540, and 541, the $1^{st}$ and $2^{nd}$ sound paths may be in a sealing state, and may maintain the sealing state. A reference numeral 511 denotes a $1^{st}$ sound hole to be connected to the $1^{st}$ sound element portion 53, and a reference numeral 512 denotes a $2^{nd}$ sound hole to be connected to the $2^{nd}$ sound element portion 54.

Figure 6A:
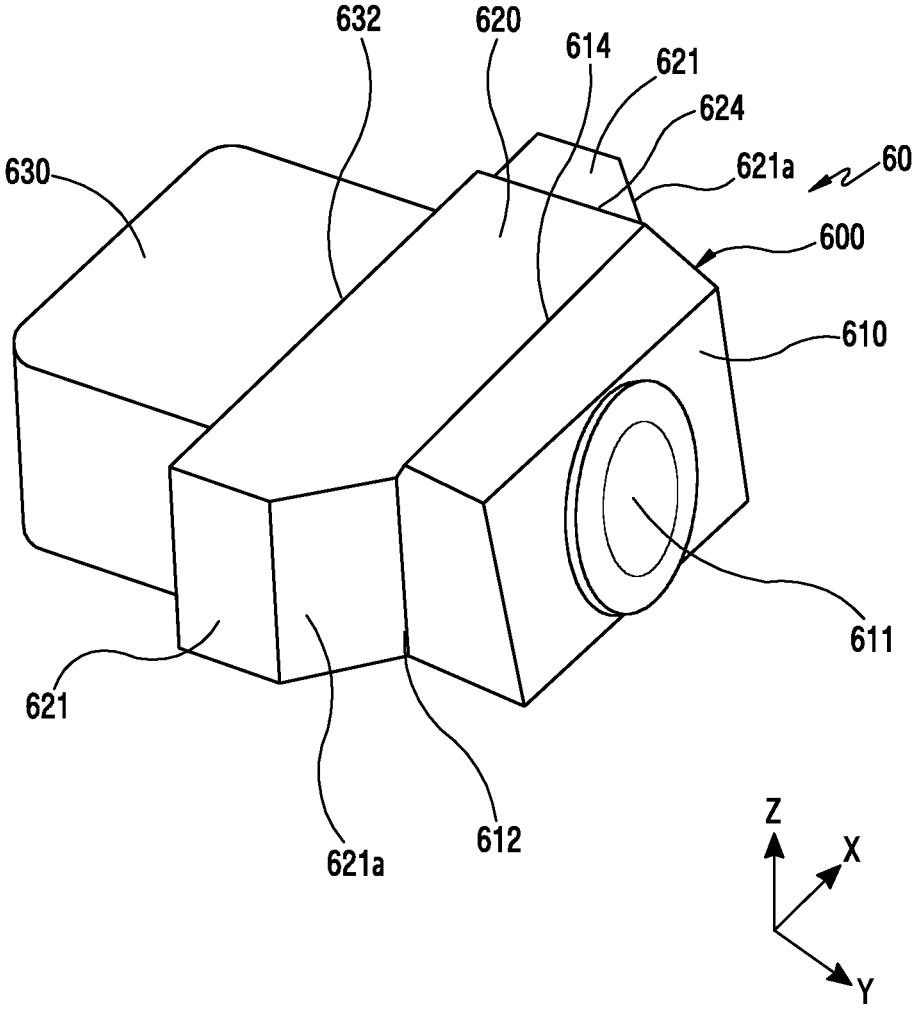
FIG. 6A and FIG. 6B are perspective views illustrating example sound element portions placed in a wearable device according to various example embodiments of the present disclosure.
Figure 6B:
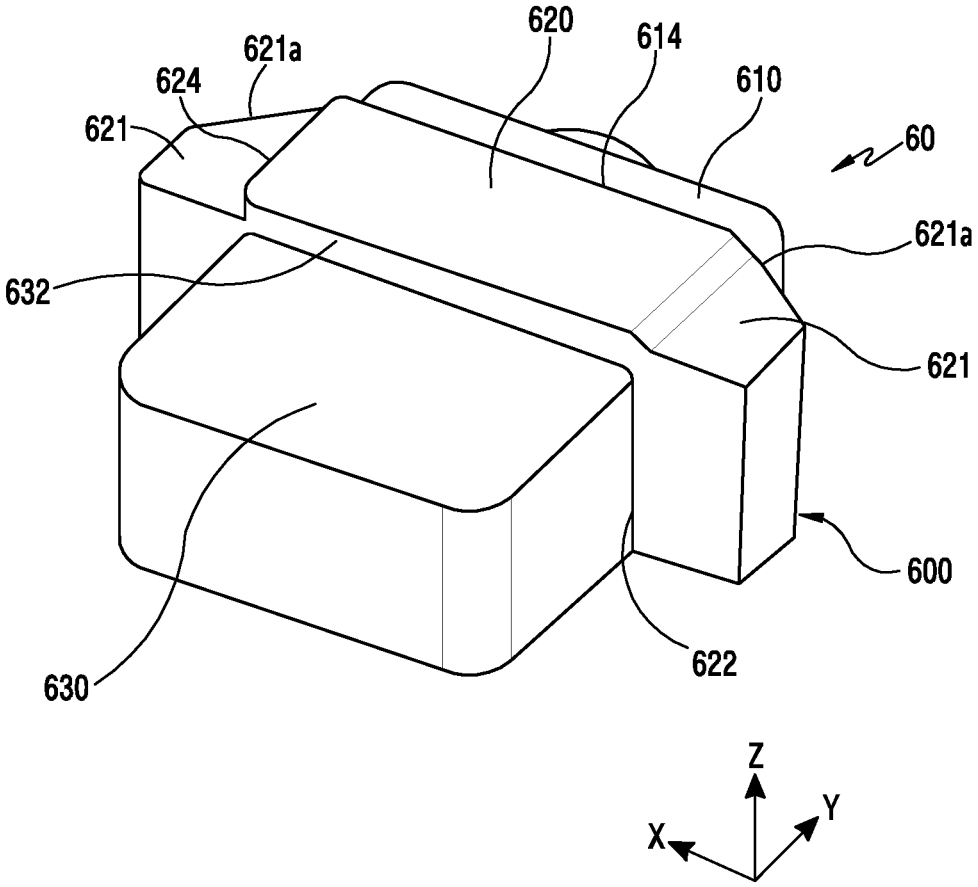

FIG. 6A and FIG. 6B are perspective views illustrating sound element portions placed in a wearable device according to various example embodiments of the present disclosure.

Referring to FIG. 6A and FIG. 6B, a $1^{st}$ sound element portion according to the various example embodiments may be the same as or similar to the $1^{st}$ sound element portions of FIG. 3 to FIG. 5, and may be the same as or similar to the $2^{nd}$ sound element portions of FIG. 3 to FIG. 5.

A $1^{st}$ sound element portion 60 according to the various example embodiments may include a $1^{st}$ sound element (as illustrated in FIG. 3 and FIG. 4) and a $1^{st}$ sound cover portion 600 for covering the $1^{st}$ sound element. The aforementioned sound cover portion may be called a protection unit or a protection member since it protects the sound element, may be called a sealing unit or a sealing member since it has a sealing function, may be called a holding portion or a holder since it holds a location of placing the sound element, and may be called a sound guide or a sound guide member since it has a duct structure for connection from a sound hole to the sound element.

The $1^{st}$ sound cover portion 600 according to the various example embodiments may include a front portion 610, a rear portion 630, and a middle portion 620. The front portion 610 may be a portion closest to the sound hole of the housing, and the rear portion 630 may be a portion farthest from the sound hole of the housing. The front portion 610 may have a duct (opening) 611 disposed to be tightly attached to the sound hole of the housing and extended in a $1^{st}$ direction for connection to the sound hole. A pair of $1^{st}$ protrusions 621 may be formed on the middle portion 620. Each of the $1^{st}$ protrusion 621 may protrude in a $2^{nd}$ direction which is a vertical direction of the $1^{st}$ direction. In the $1^{st}$ sound cover portion 600 according to the various example embodiments, a $1^{st}$ step 612 may be configured between a lateral surface of the front portion 610 and a lateral surface of the $1^{st}$ protrusion 621, and a $2^{nd}$ step 622 (see FIG. 6B) may be configured between the lateral surface of the $1^{st}$ protrusion 621 and the lateral surface of the rear portion 630. A $3^{rd}$ step 632 may be configured between an upper surface of the middle portion 620 and an upper surface of the rear portion 630. The $1^{st}$ sound element portion 60 may be prevented from being moved in a $1^{st}$ direction(−) by being coupled to a peripheral structure between the upper surfaces of the $3^{rd}$ step 632 and the rear portion 630. For example, the peripheral structure may include a substrate, a supporting structure, a housing, or the like. Further, the $1^{st}$ sound cover portion 600 may have a $1^{st}$ inclined surface 621*a* on the $1^{st}$ protrusion 621.

The $1^{st}$ sound cover portion 600 according to the various example embodiments may have a $4^{th}$ step 614 between the upper surface of the front portion 610 and the upper surface of the middle portion 620. Further, a $5^{th}$ step 624 may be configured between the upper surface of the middle portion 620 and one $1^{st}$ protrusion 621.

Figure 7:
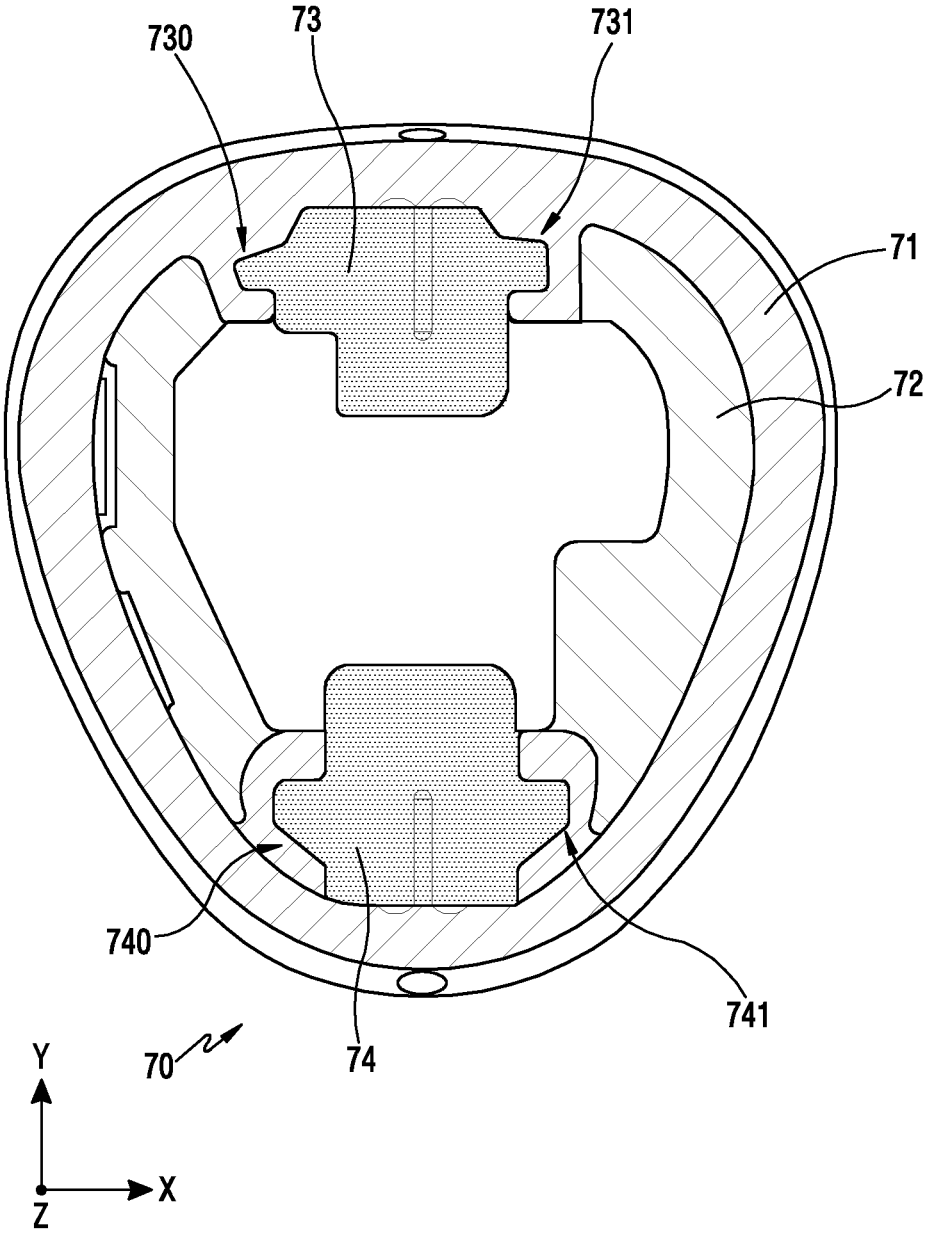
FIG. 7 is a cutaway cross-sectional view illustrating an example state in which $1^{st}$ and $2^{nd}$ sound element portions are placed in a wearable device, cut along an XY plane, according to various example embodiments of the present disclosure.

FIG. 7 is a cutaway cross-sectional view illustrating a state in which $1^{st}$ and $2^{nd}$ sound element portions are disposed in a wearable device, cut along an XY plane, according to various example embodiments of the present disclosure.

Referring to FIG. 7, in a wearable device 70 according to the various example embodiments, $1^{st}$ and $2^{nd}$ coupling structures 730, 731, 740, and 741 of $1^{st}$ and $2^{nd}$ sound element portions 73 and 74 may be formed on a housing 71. Although it is exemplified in FIG. 5 that each of the $1^{st}$ and $2^{nd}$ coupling structures 530, 531, 540, and 541 of the $1^{st}$ and $2^{nd}$ sound element portions 53 and 54 is formed on the supporting structure 52, the present disclosure is not limited thereto.

Further, if the housing 71 and the supporting structure 72 are configured as one-piece type structure, the $1^{st}$ and $2^{nd}$ coupling structures of the $1^{st}$ and $2^{nd}$ sound element portions 73 and 74 may be formed on the one-piece type structure.

Figure 8:
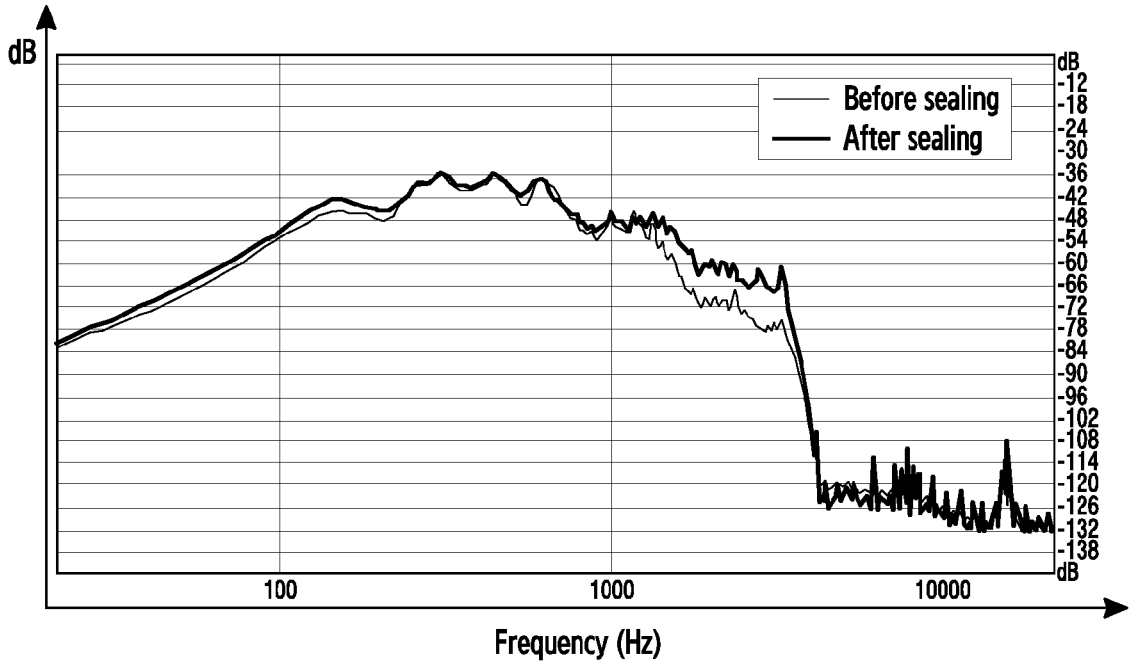
FIG.8 PRIOR ART
FIG. 8 is a graph illustrating an example characteristic of a sound element based on whether a sound hole is open or closed in a wearable device according to the prior art.
Figure 9:
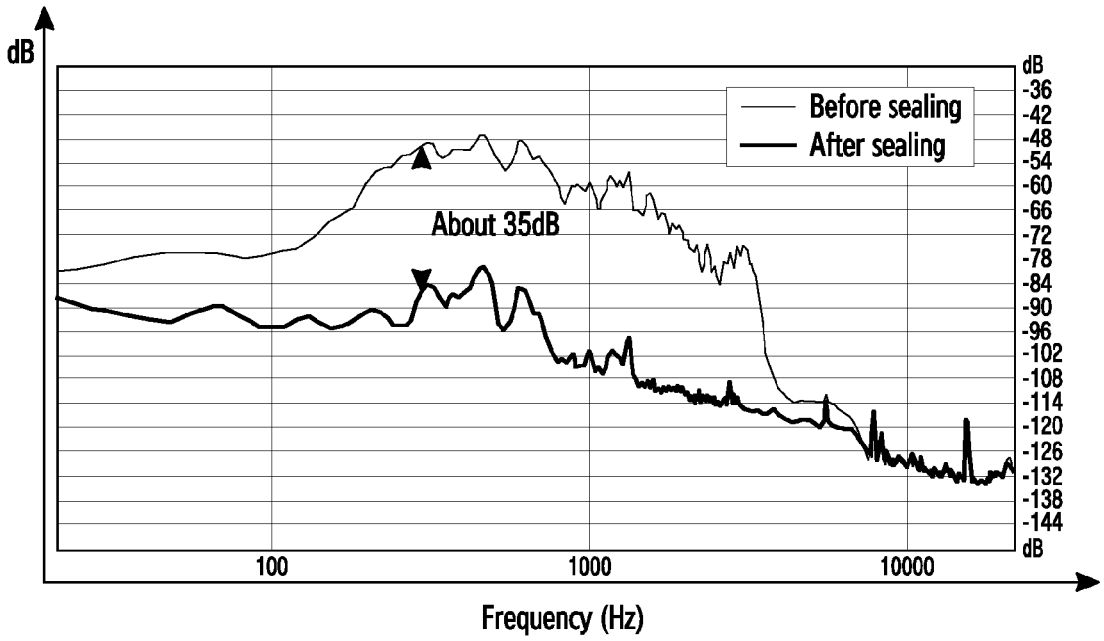
FIG. 9 is a graph illustrating an example improved characteristic of a sound element based on whether a sound hole is open or closed in a wearable device according to various example embodiments of the present disclosure.

FIG. 8 is a graph illustrating a characteristic of a sound element on the basis of whether a sound hole is open or closed in a wearable device according to the prior art. FIG. 9 is a graph illustrating an improved characteristic of a sound element on the basis of whether a sound hole is open or closed in a wearable device according to various example embodiments of the present disclosure.

Referring to FIG. 8 and FIG. 9, a sound characteristic of a sound element (e.g., a microphone) depending on whether a wearable device has a sealing structure is described below according to various example embodiments of the present disclosure.

Referring to FIG. 8, it can be seen that the sound element disposed as illustrated in FIG. 1 does not have a great difference in the sound characteristic of the microphone in most frequency bands irrespective of a state in which a sound duct is not closed yet (e.g., a sound hole is open) or is closed (e.g., the sound hole is closed). In other words, it can be seen that a sound leakage occurs in the duct structure of the sound element disposed as shown in FIG. 1 since it is not a sealing structure.

Referring to FIG. 9, it can be seen that the sound element disposed as illustrated in FIG. 5 has a great difference in the sound characteristic of the microphone in most frequency bands irrespective of a state in which a sound duct is not closed yet (e.g., a sound hole is open) or is closed (e.g., the sound hole is closed). That is, the duct structure of the sound element disposed as illustrated in FIG. 5 is configured with a sealing structure, thereby providing an effect in which a sound characteristic is improved (or noise is reduced) by about 35 dB.

According to various example embodiments of the present disclosure, a wearable device may include a housing having at least one or more sound holes, at least one or more substrates fixed inside the housing, and at least one or more sound element portions comprising a sound element disposed in the housing to face a $1^{st}$ direction(+) and having a sound path comprising a duct structure configured to connect the sound element to the sound hole. At least one or more coupling structures on which a coupling force is exerted in a $2^{nd}$ direction facing a vertical direction of the $1^{st}$ direction may be formed between the housing and the sound element portion. The sound element portion may be prevented from and/or resist being moved back in a $1^{st}$ direction (−) due to the at least one or more coupling structures.

According to various example embodiments of the present disclosure, a sealing may be achieved between the sound hole and the duct structure by the coupling structure.

According to various example embodiments of the present disclosure, the housing may further include at least one or more supporting structures. The coupling structure may be disposed between the supporting structure and the sound element.

According to various example embodiments of the present disclosure, the sound element portion may include a sound element mounted on a $1^{st}$ surface of the substrate, and a sound cover disposed to cover the sound element, having a duct structure for spatially connecting a sound hole to the sound element, and coupled to the supporting structure.

According to various example embodiments of the present disclosure, the coupling structure may have a concavo-convex shape.

According to various example embodiments of the present disclosure, the coupling structure may include at least one or more protrusions protruding from the sound cover portion in the $2^{nd}$ direction, and at least one or more recesses corresponding to the at least one or more protrusions and being formed in the supporting structure in the $2^{nd}$ direction and coupled to the protrusion to provide the coupling force.

According to various example embodiments of the present disclosure, the sound cover portion may include a front portion disposed to be close to the sound hole, a middle portion having at least one or more protrusions protruding in the $2^{nd}$ direction, and a rear portion extending from the middle portion in the $1^{st}$ direction. A step may be further provided between an upper surface of the middle portion and an upper surface of the rear portion.

According to various example embodiments of the present disclosure, a peripheral structure may be coupled between the step and the upper surface of the rear portion, so that the sound element portion is prevented from and/or resists being moved in the $1^{st}$ direction(−) due to the peripheral structure.

According to various example embodiments of the present disclosure, the peripheral structure may be configured of any one of a substrate, a supporting structure, and a housing or a combination thereof.

According to various example embodiments of the present disclosure, the housing may include any one of an ear set, a hearing aid, and an ear-type headset as a device having an ear mold and worn in an ear.

According to various example embodiments of the present disclosure, the sound element may include at least one or more microphones.

According to various example embodiments of the present disclosure, the sound element portion may include a $1^{st}$ sound element portion disposed on a $1^{st}$ surface of the substrate to face a $1^{st}$ direction(+) of the housing, and a $2^{nd}$ sound element portion disposed to face a $1^{st}$ direction(−) which is an opposite direction of the $1^{st}$ direction(+) of the housing, and disposed on a $1^{st}$ surface of the substrate to face the $1^{st}$ sound element portion.

According to various example embodiments of the present disclosure, the substrate may include $1^{st}$ and $2^{nd}$ substrates fixed to a supporting structure in a multi-layered manner, and the $1^{st}$ and $2^{nd}$ sound element portions may be disposed to directly face each other in a space between the $1^{st}$ and $2^{nd}$ substrates.

The coupling structure may include a $1^{st}$ coupling structure formed between the $1^{st}$ sound element portion and the supporting structure to prevent the $1^{st}$ sound element portion from being moved in the $1^{st}$ direction(−), and a $2^{nd}$ coupling structure formed between the $2^{nd}$ sound element portion and the supporting structure to prevent the $2^{nd}$ sound element portion from being moved in the $1^{st}$ direction(+).

According to various example embodiments of the present disclosure, a wearable device worn in an ear may include an ear mold, a housing worn in an ear by means of the ear mold and having at least one or more sound holes, a support structure coupled to the inside of the housing to fix an internal element, at least one or more substrates supported by a supporting structure in the housing, and at least one or more sound element portions placed to the housing to face a $1^{st}$ direction(+) and having a duct structure for connection to the sound hole. At least one or more coupling structures may be formed in a $2^{nd}$ direction facing a vertical direction of the $1^{st}$ direction(+) between the supporting structure and the sound element portion. The sound element portion may be prevented from and/or resist being moved in the $1^{st}$ direction(−) due to the at least one or more coupling structures, and thus a sealing may be achieved between the sound hole and the duct structure.

According to various example embodiments of the present disclosure, the sound element portion may include a sound element, a sound cover portion for covering the sound element so as to cover some surfaces or the remaining surfaces other than a contact surface in contact with the substrate, and a duct structure extended from the sound element to up to the sound hole.

According to various example embodiments of the present disclosure, the sound cover portion may include a front portion tightly attached to the sound hole, a middle portion having the one pair of protrusions protruding in a $2^{nd}$ direction, and a rear portion extended from the middle portion in a $1^{st}$ direction. At least two or more steps may be further provided.

According to various example embodiments of the present disclosure, a step may be further provided to a portion in which an upper surface of the middle portion and an upper surface of the rear portion meet. A peripheral structure may be coupled in a space prepared by the middle portion and the step, so as to prevent the sound element portion from being moved back in a $1^{st}$ direction(−).

Each of the above-described elements of the electronic device may include one or more components, and the name of a corresponding element may vary according to the type of electronic device. The electronic device according to the present disclosure may include at least one of the above-described elements and may exclude some of the elements or further include other additional elements. Further, some of the elements of the electronic device according to the present disclosure may be coupled to form a single entity while performing the same functions as those of the corresponding elements before the coupling.

The term "module," as used herein may represent, for example, a unit including a combination of one or two or more of hardware, software, or firmware. The "module" may be, for example, used interchangeably with the terms "unit", "logic", "logical block", "component", or "circuit" etc. The "module" may be the minimum unit of an integrally constructed component or a part thereof. The "module" may be also the minimum unit performing one or more functions or a part thereof. The "module" may be implemented mechanically or electronically. For example, the "module" may include at least one of various processing circuitry, such as, for example, and without limitation, a dedicated processor, an application-specific integrated circuit (ASIC) chip, Field-Programmable Gate Arrays (FPGAs) and a programmable-logic device performing some operations known to the art or to be developed in the future.

While the present disclosure has been illustrated and described with reference to certain example embodiments thereof, it will be apparent to those skilled in the art that the wearable device according to the present disclosure is not limited to these example embodiments, and various changes in form and details may be made therein without departing from the spirit and scope of the present disclosure as defined by the appended claims.

What is claimed is:

1. A wearable device comprising:

a housing having at least one or more sound holes;

one or more substrates fixed inside the housing; and one or more sound element portions, each comprising a sound element, disposed in the housing to face a $1^{st}$ direction(+) and having a sound path comprising a duct structure for connection to the sound hole, wherein at least one or more coupling structures on which a coupling force is exerted in a $2^{nd}$ direction facing a vertical direction of the $1^{st}$ direction are formed between the housing and the sound element portion, and wherein the sound element portion is configured to resist being moved in a direction opposite the $1^{st}$ direction (+) by the at least one or more coupling structures, wherein the housing further comprises at least one supporting structure, and the coupling structure is disposed between the supporting structure and the sound element portion, wherein the sound element portion comprises:

a sound element mounted on a $1^{st}$ surface of the substrate; and a sound cover disposed to cover the sound element, and including a duct structure configured to spatially connect a sound hole in the sound element, the sound cover being coupled to the supporting structure.

2. The device of claim 1, wherein the coupling structure is configured to provide a seal between the sound hole and the duct structure.

3. The device of claim 1, wherein the coupling structure has a concavo-convex shape.

4. The device of claim 1, wherein the coupling structure comprises:

one or more protrusions protruding from the sound cover in the $2^{nd}$ direction; and one or more recesses corresponding to the one or more protrusions and configured to receive the respective one or more protrusions, the one or more recesses being formed to be recessed from the supporting structure in the $2^{nd}$ direction and coupled to the one or more protrusions to provide the coupling force.

5. The device of claim 4, wherein the sound cover comprises:

a front portion disposed toward the sound hole;

a middle portion comprising at least one or more protrusions protruding in the $2^{nd}$ direction; and a rear portion extending from the middle portion in the $1^{st}$ direction, wherein a step is provided between an upper surface of the middle portion and an upper surface of the rear portion.

6. The device of claim 5, further comprising a peripheral structure coupled between the step and the upper surface of the rear portion, and configured to resist movement of the sound element portion in the $1^{st}$ direction(−).

7. The device of claim 6, wherein the peripheral structure comprises at least one of: a substrate, a supporting structure, and a housing.

8. The device of claim 1, wherein the housing comprises at least one of: an ear set, a hearing aid, and an ear-type headset as a device including an ear mold and configured to be worn in an ear.

9. The device of claim 1, wherein the sound element comprises at least one or more microphones.

10. The device of claim 1, wherein the sound element portion comprises:

a $1^{st}$ sound element portion disposed on a $1^{st}$ surface of the substrate to face a $1^{st}$ direction(+) of the housing; and a $2^{nd}$ sound element portion disposed to face a $1^{st}$ direction(−) the $1^{st}$ direction(+) of the housing, and disposed on a $1^{st}$ surface of the substrate to face the $1^{st}$ sound element portion.

11. The device of claim 10, wherein the substrate comprises $1^{st}$ and $2^{nd}$ substrates fixed to a supporting structure in a multi-layered manner, and the $1^{st}$ and $2^{nd}$ sound element portions are disposed to face each other in a space between the $1^{st}$ and $2^{nd}$ substrates.

12. The device of claim 10, wherein the coupling structure comprises:

a $1^{st}$ coupling structure formed between the $1^{st}$ sound element portion and the supporting structure and configured to resist movement of the $1^{st}$ sound element portion in the $1^{st}$ direction(−); and a $2^{nd}$ coupling structure formed between the $2^{nd}$ sound element portion and the supporting structure and configured to resist movement of the $2^{nd}$ sound element portion in the $1^{st}$ direction(+).

13. A wearable device worn in an ear, the device comprising:

an ear mold;

a housing coupled to the ear mold and including at least one or more sound holes;

a supporting structure coupled to the housing and configured to fix an internal element;

at least one or more substrates supported by the supporting structure in the housing; and at least one or more sound element portions disposed in the housing to face a $1^{st}$ direction(+) and including a duct structure for connection to the sound hole, wherein at least one or more coupling structures are formed in a $2^{nd}$ direction facing a vertical direction of the $1^{st}$ direction(+) between the supporting structure and the sound element portion, and wherein the sound element portion configured to resist movement in the $1^{st}$ direction(−) due to the at least one or more coupling structures, wherein the one or more coupling structures are configured to provide a seal between the sound hole and the duct structure, wherein the housing further comprises at least one supporting structure, and the coupling structure is disposed between the supporting structure and the sound element portion, wherein the sound element portion comprises:

a sound element;

a sound cover covering the sound element and covering some surfaces other than a contact surface in contact with the substrate; and a duct structure extending from the sound element to the sound hole.

14. The device of claim 13, wherein the sound cover comprises:

a front portion tightly attached to the sound hole;

a middle portion including a pair of protrusions protruding in a $2^{nd}$ direction; and a rear portion extending from the middle portion in a $1^{st}$ direction, and comprising two or more steps.

15. The device of claim 14, wherein a step is provided at a portion where an upper surface of the middle portion and an upper surface of the rear potion meet, and a peripheral structure is coupled in a space formed by the middle portion and the step, so as to resist movement of the sound element portion in a $1^{st}$ direction(−).

* * * * *